United States Patent [19]

Takai et al.

[11] Patent Number: 4,725,698

[45] Date of Patent: Feb. 16, 1988

[54] ELECTRIC CONNECTOR DEVICE

[75] Inventors: Nobuei Takai; Haruo Sakamoto; Kouzou Uekido; Michiaki Nishiyama, all of Tokyo, Japan

[73] Assignees: Du Pont Japan Ltd.; NEC Corporation, both of Tokyo, Japan

[21] Appl. No.: 936,420

[22] Filed: Dec. 1, 1986

[30] Foreign Application Priority Data

| | | | |
|---|---|---|---|
| Nov. 30, 1985 | [JP] | Japan | 60-184571[U] |
| Feb. 14, 1986 | [JP] | Japan | 61-19968[U] |
| May 28, 1986 | [JP] | Japan | 61-80765[U] |

[51] Int. Cl.[4] ..... H01H 9/20

[52] U.S. Cl. ..... 200/50 B; 200/16 D; 200/51 R

[58] Field of Search ..... 200/16 B, 16 C, 16 D, 200/16 E, 16 F, 51 R, 51.09, 51.1, 50 B

[56] References Cited

U.S. PATENT DOCUMENTS

| | | | |
|---|---|---|---|
| 2,815,420 | 12/1957 | Moyer | 200/16 A X |
| 3,209,091 | 9/1965 | Freathy et al. | 200/51 R |
| 3,370,140 | 2/1968 | Betts | 200/51.1 |
| 3,846,596 | 11/1974 | Wolf | 200/16 D |
| 4,029,917 | 6/1977 | Webster | 200/16 D X |
| 4,095,060 | 6/1978 | Keprda | 200/16 D |
| 4,180,712 | 12/1979 | Lutzenberger et al. | 200/16 D |
| 4,332,987 | 6/1982 | Hoffman | 200/16 D |
| 4,501,940 | 2/1985 | Suzuki | 200/16 A |

*Primary Examiner*—J. R. Scott

[57] ABSTRACT

A connector device is disclosed which can branch or terminate signal lines for making a mutual connection among a plurality of units. The connector device includes switches between signal line connection terminals so that the connector may serve as both a branch connector and a strap connector. A hook is provided on a body case of the connector device and usable in interlock with the switch. A groove engageable with the hook is formed on a connector element case for external circuit connection so that through the selective engagement of the hook with the groove the element case is prevented from being inadvertently detached from the body case. During the detachment of the element case, the contact pin is placed in a short-circuited state at all times. A terminating connector device is also disclosed which is comprised of a combination of a connector body with first and second connector elements. The connector body includes first and second pairs of terminal. The first connector element has two terminals detachably connected to the corresponding terminals in the first pair and second connector element has two terminals detachably connected to the terminals in the second pair. A terminating resistor is inserted between the two terminals of the first elements. An additional connector element is prepared which is of the same type as the second connector element with no such terminating resistor. The additional connector element is matingly connected to the connector body in place of the connector element with the terminating resistor, thereby providing a branch connector.

19 Claims, 12 Drawing Figures

ELECTRIC CONNECTOR DEVICE

BACKGROUND OF THE INVENTION

This invention relates to an electric connector device for use in branching and/or terminating signal lines for connecting together a plurality of units and, in particular, a plurality of information processing units.

In an information processing system, as shown in FIG. 1A, main information processing unit 100 is connected to a plurality of information processing terminal units 200 through common lines 300 and 400 to allow a mutual information exchange among information processing terminal units 200. Conventional branch connectors 500 are placed where signal lines 300 and 400 are led out to respective units 200.

Branch connector 500 comprises two connector sections 510 for signal connection, branch connector body 520 and connector section 530 for external connection as shown briefly in FIG. 1A and in detail in FIG. 2. Branch connector body 520 has contact pins 511, 512, 513 and 514 comprising signal connection terminals 501, 502, 503 and 504, respectively, for connection to signal lines 300 and 400, and comprising external circuit connection terminals 505, 506, 507 and 508, respectively. External circuit connection terminals 505 and 506 are connected to each other by connection lines 201*a* and 201*b* and to connection line 201 connected to terminal 202 of information processing terminal unit 200. External circuit connection terminals 507 and 508 are connected to each other by connection lines 203*a* and 203*b* and to connection line 203 leading to terminal 204 of information processing terminal unit 200. In this way, terminals 202 and 204 at one information processing terminal unit are connected to those at another information processing terminal unit by branched signal lines 300 and 400 to allow a mutual signal exchange between these units.

Information processing terminal unit 200 connected to branch connector 500 is detached, as required, and at the same time connection section 530 is disconnected from branch connector body 520. Upon disconnecting the connection section from the branch connector, signal lines 300 and 400 are separated at the location of terminals 505 to 508 for external circuit connection, as shown in FIG. 1B. Strap connector 700 is attached to branch connector body 520 so disconnected. As shown in FIG. 1A and, particularly in FIG. 3, strap connector 700 is so configured that wires 701 and 702 are connected one between terminals 505 and 506 of branch connector body 520 and one between terminals 507 and 508 at the branch connector body. With the use of strap connector 700 a signal is relayed at the location of the branch connector body so that it is transferred among the units.

Terminating branch connector 600 is connected at a location remotest from main information processing unit 100 such that terminating resistors 603 are soldered between terminals 601 and 602 on printed circuit board 610 and that signal lines 300 and 400 are connected to each other through terminating resistors 603.

In the conventional branch connector, when the information processing unit is to be disconnected from the branch connector, the signal lines will be broken unless the strap connector has to be connected to a branch connector. Furthermore, where the strap connector is inadvertently disconnected, a signal will be interrupted at a location of the branch connector so that a signal exchange among the units through the branch connector cannot be achieved. If any extra information processing terminal unit is to be added at the aforementioned information processing unit system, terminating branch connector 600 is spaced away from both adjacent branch connector 500 and terminal unit 200 so that a new branch connector should be connected between the terminating branch connector on one hand and the new terminal unit 200 on the other hand. In this case, the terminating branch connector has to be newly connected to the new terminal unit to be added, requiring a cumbersome operation.

SUMMARY OF THE INVENTION

A first object of this invention is to provide a branch connector device which no longer requires any strap connector in the aforementioned information processing system.

A second object of this invention is to provide a branch connector device which never involves a breakage of signal lines during the attachment and detachment of an information processing unit.

A third object of this invention is to provide a connector device which can readily make a mutual connection of a branch connector and terminating branch connector, and a connection and disconnection between these connectors and system, in the aforementioned information processing unit, during a brief period of time.

In the first aspect of this invention a branch connector device is provided which comprises a first signal line connection terminal, a first external circuit connection terminal connected to the first signal line connection terminal, a second signal line connection terminal, and a second external circuit connection terminal connected to the second signal line connection terminal, in which switch means is provided for making a connection and disconnection between the first and second signal line connection terminals.

In another aspect of this invention the branch connector device in the first aspect is provided which comprises:

(1) a connector body including:

(a) a body case comprised of the connector body, (b) the first contact pin having the first signal line connection terminal and first external circuit connection terminal, (c) the second contact pin arranged in parallel with the first contact pin and having the second signal line connection terminal and second external circuit connection terminal, (d) a slide piece for selectively conducting the first and second contact pins, and (e) a slide plate to which the slide piece is connected, the slide plate being arranged in said body case such that it is slidably moved across the first and second contact pins in a direction perpendicular to the pin with the slide piece attached as one unit thereto, and the slide plate having a hook extending in a direction perpendicular to that in which the slide plate is moved; and (2) a connector element for external circuit connection, including:

(a) a connector element case fitted in said body case, (b) first and second connection terminals adapted to be connected to the first and second external connection terminals of the first and second contact pins, (c) a guide groove formed on the element case to allow the hook of the slide plate to be guided with the element case oriented for attachment, and (d) a locking groove communicating with the guide groove to allow the hook to be locked upon the slide plate.

The connector element case is inserted into the body case while the hook is guided along the guide groove and, in this state, the slide plate is slidably moved to bring the hook into locking engagement with the locking groove.

The connector device includes the switches between the signal line connection terminals so that the connector may serve as both a branch connector and a strap connector. Through the selective engagement of the hook with the groove, the element case is prevented from being inadvertently detached from the body case. During the detachment of the element case, the contact pin is placed in a short-circuited state at all times.

In the third aspect of this invention a connector device is provided which is comprised of a combination of a connector body with first and second connector elements in which the connector body has first and second pairs of terminals, first connector element has two terminals detachably connected to the two terminals in the first pair, second connector has two terminals detachably connected to the two terminals in the second pair and a terminating resistor is inserted between the two terminals in one of the first and second pairs.

In the connector device so constructed, the four terminals of the connector body are connected at one end to, for example, one information processing terminal unit and at the other end to the first and second connector elements to provide a terminating branch connector. If a connector element of the same type as the connector element with no terminating resistor is matingly connected to the connector body in place of the connector element with the terminating resistor, the resultant connector serves as a branch connector. Using proper connector elements, the terminating connector can be converted to the branch connector, and vice versa, while the "connected" state is maintained between the terminal unit and the connector body. It is therefore easy to, for example, increase and decrease such terminal units in the information processing unit.

DESCRIPTION OF THE PREFERRED EMBODIMENTS

Figures 1A, 1B:
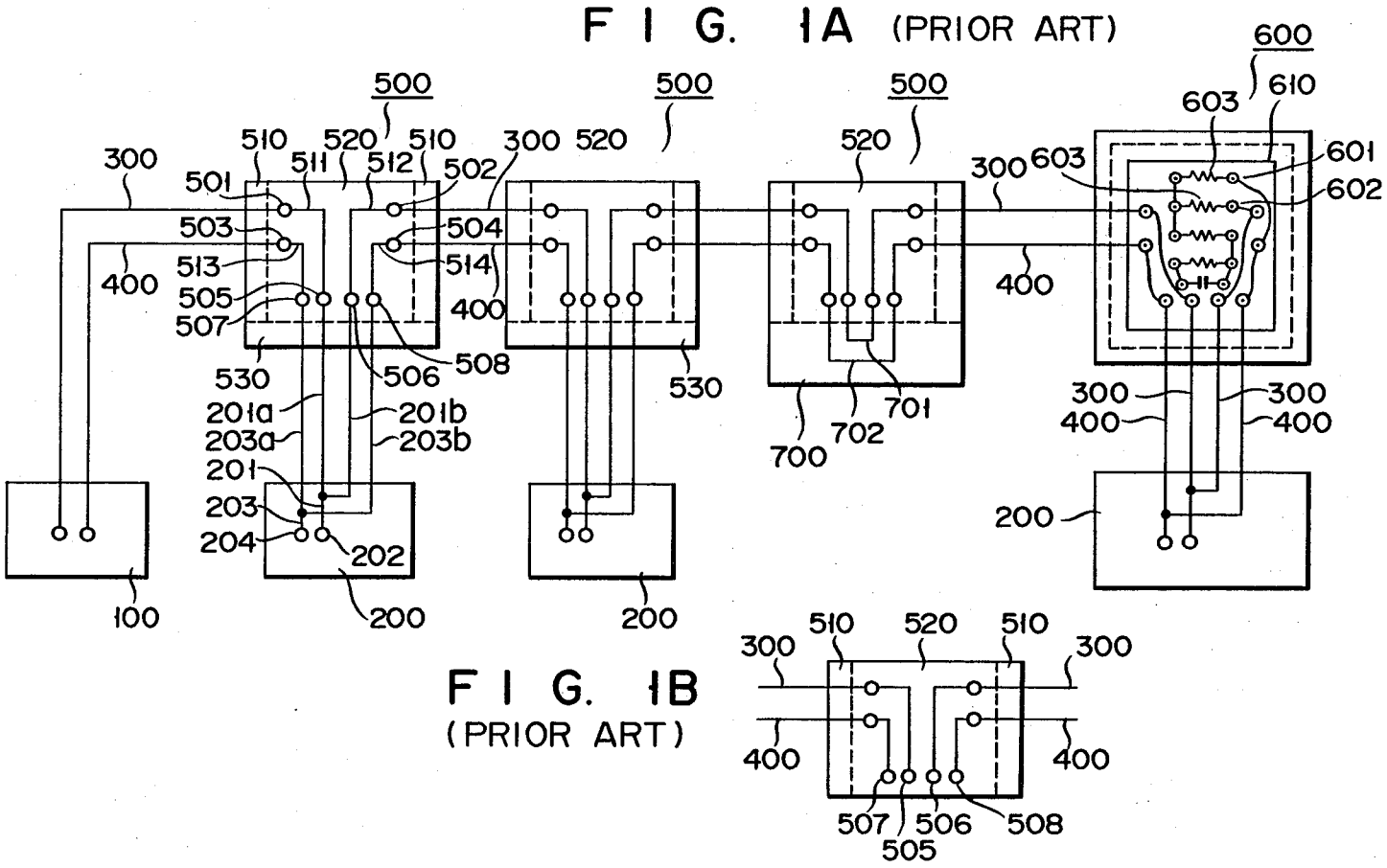
FIG. 1A (PRIOR ART)
FIG. 1B (PRIOR ART)
FIG. 1A and FIG. 1B are views showing a prior art information processing system including conventional branch connectors and terminating connector, FIG 1A showing a signal line circuit model for these connectors and FIG. 1B showing the branch connector of FIG. 1A, without a strap connector.
Figure 2:
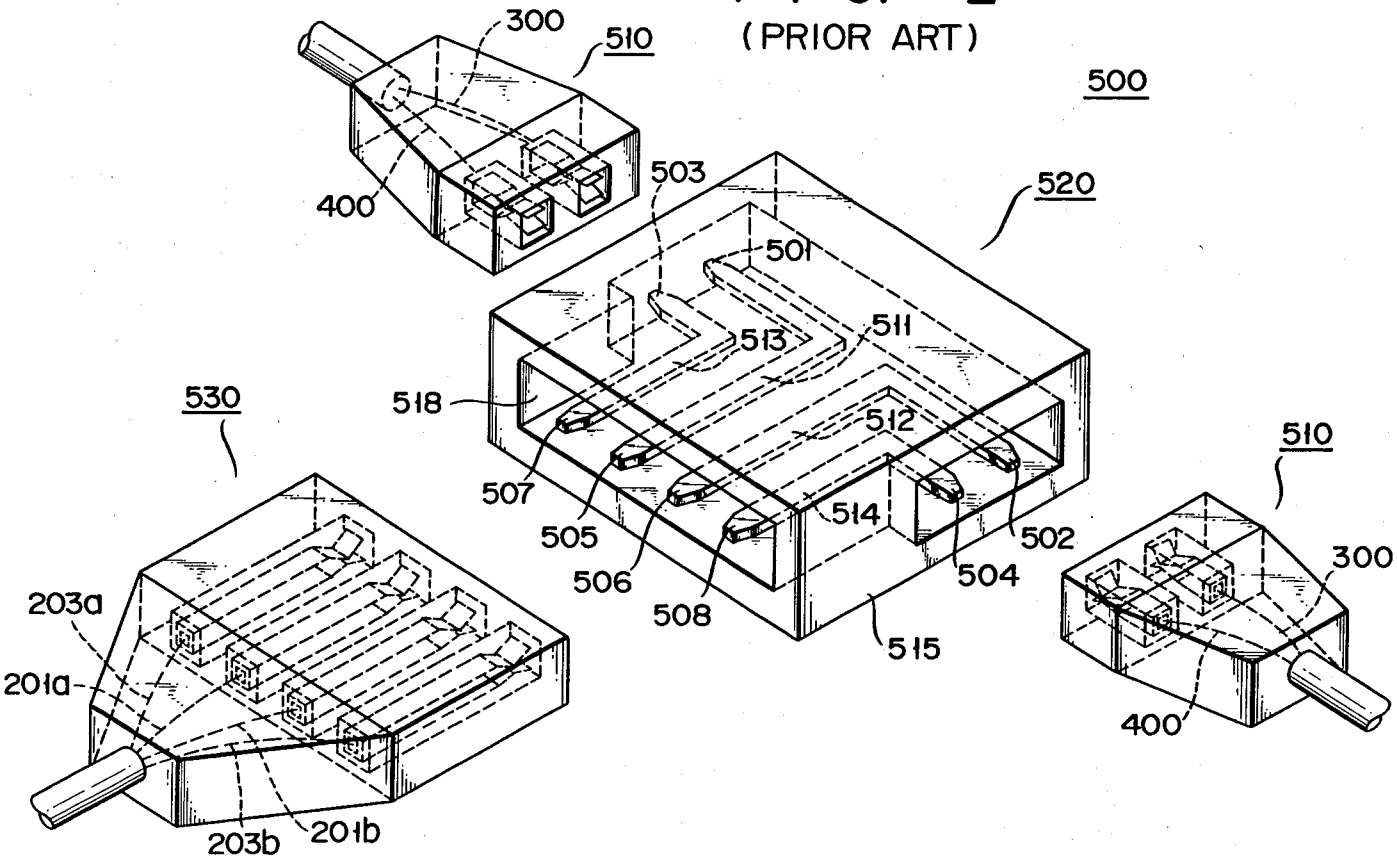
FIG. 2 (PRIOR ART)
FIG. 2 is a perspective view showing the structure of the branch connector of FIG. 1A.
Figure 3:
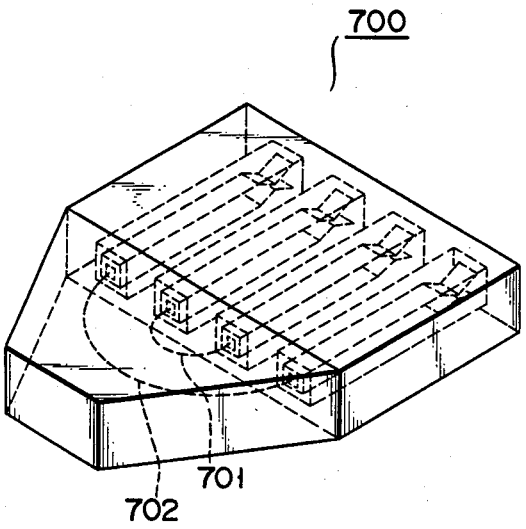
FIG. 3 (PRIOR ART)
FIG. 3 shows a strap connector as used in place of the connector section for external connection shown in FIG. 2.
Figure 4:
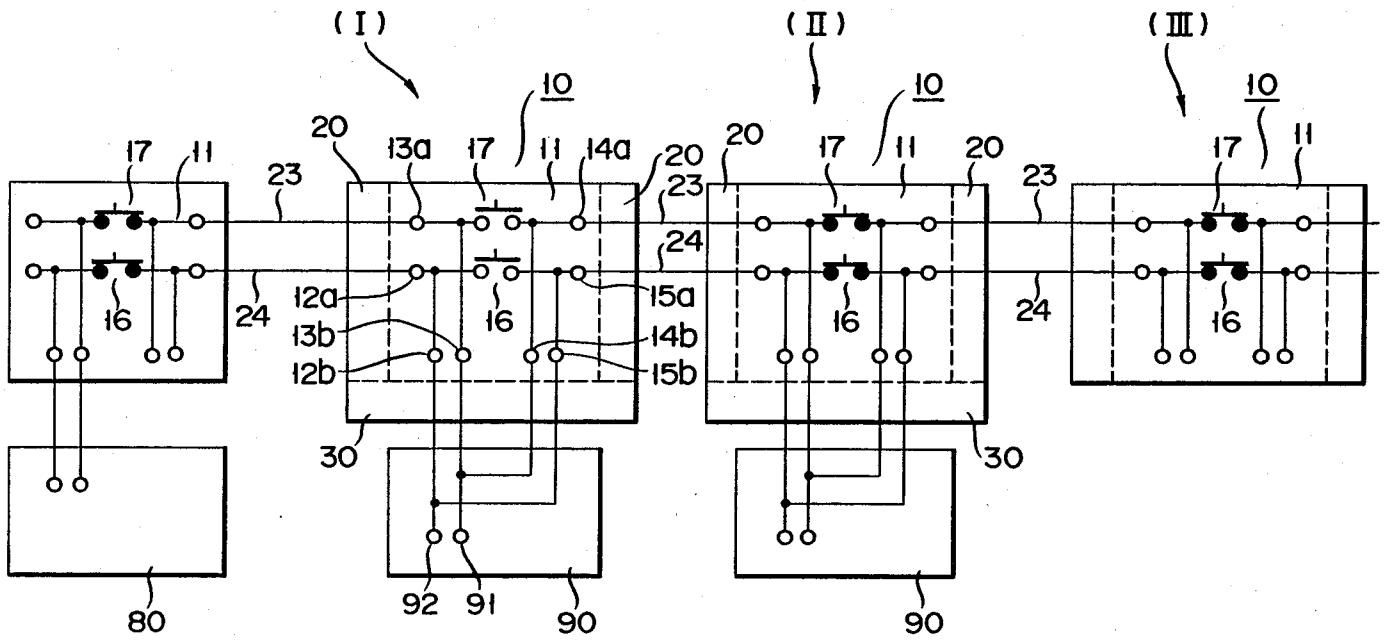
FIG. 4 shows a signal line circuit diagram for signal processing units including an electric branch connector according to one embodiment of this invention.

FIG. 4 shows a signal line circuit of a computer system with branch connectors 10 incorporated. Main information processing unit 80 is connected by common lines 23 and 24 to a plurality of information processing terminal units 90 through branch connectors 10.

Signal line connection terminals 13*a* and 14*a* and 12*a* and 15*a* are provided at respective connector 10 and connected to external circuit connection terminals 13*b*, 14*b*, 12*b* and 15*b*, respectively. Switch 17 is provided between signal line connection terminals 13*a* and 14*a* and switch 16 is provided between signal line connection terminals 12*a* and 15*a* so that terminals 13*a* and 14*a*, as well as terminals 12*a* and 15*a*, can be short-circuited relative to, or separated from, each other.

When, with unit 90 connected as shown in FIG. 4, the switches are opened as in (I) in FIG. 4, then signal lines 23 and 24 are branched to terminals 91 and 92 in unit 90. When, on the other hand, the switches are closed as in (II) and (III) in FIG. 4, signal lines 23 and 24 are short-circuited, or "strapped", respectively. In a branch connector connected to main information processing unit 80, switches are closed to allow a data exchange relative to terminal units 90.

The manner of operating switches 16 and 17 at the time of attaching and detaching unit 90 will be explained below.

Where unit 80 is not connected to unit 90, switches 17 and 16 are closed as shown in (III) in FIG. 4 to permit signals to be relayed to an associated circuit. When unit 80 is to be connected to unit 90, it is done with switches closed as indicated in (II) in FIG. 4 and then the switches are opened to allow the use of unit 90. Where the aforementioned unit so connected is to be detached, the switches are closed without cutting off the signal lines connected through the branch connector, and then cut off the connection to unit 90 with the switches closed.

In this way, the switches are normally closed during the connection operation and disconnection operation of making it easier to perform a necessary operation, such as a unit exchange, without causing an adverse effect in the other unit or units. This obviates the necessity of using any extra strap connector as encountered in the prior art device.

Figure 5:
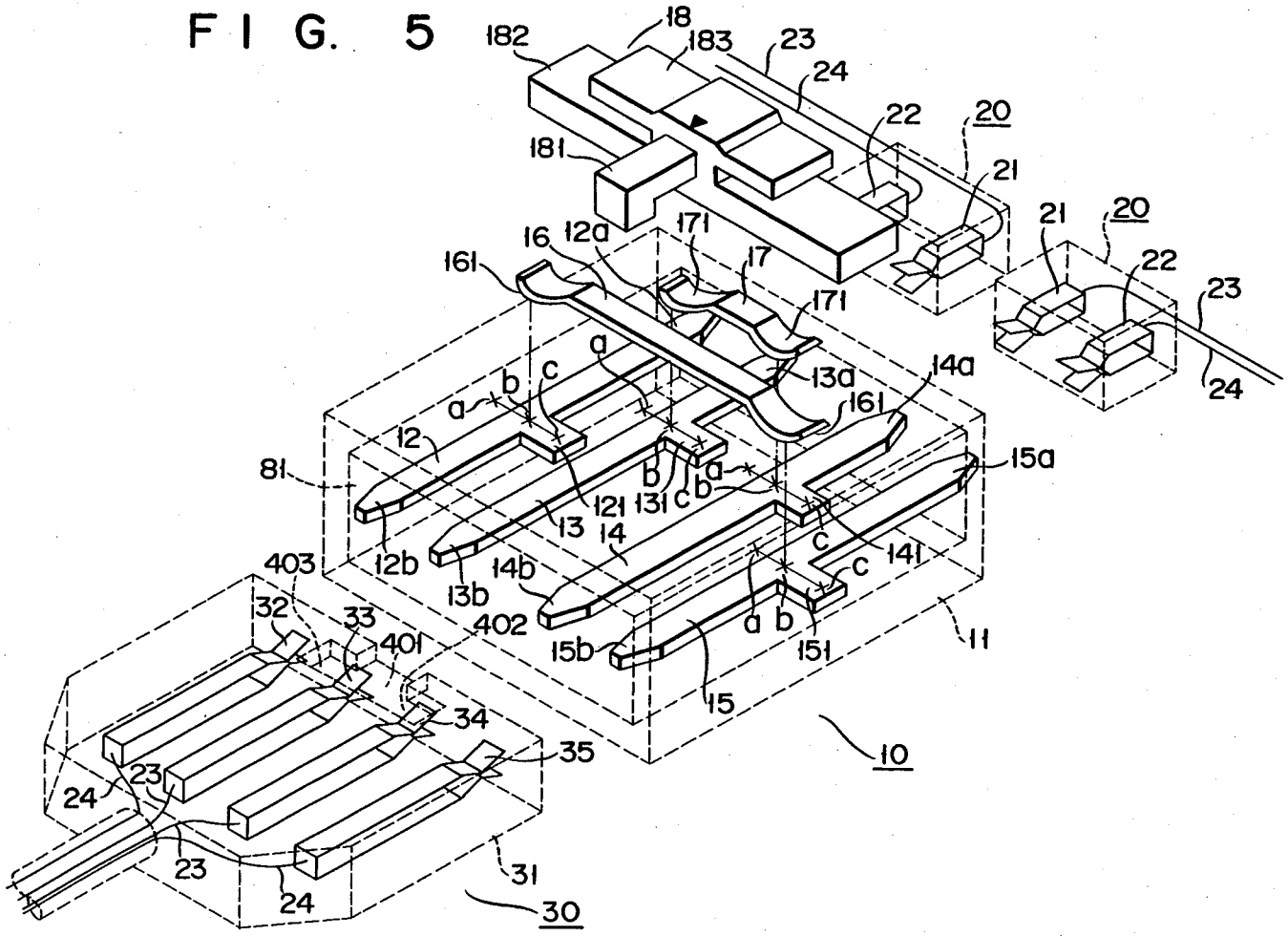
FIG. 5 is an exploded perspective view showing a branch connector of FIG. 4 with an internal pin structure exposed.
Figure 6:
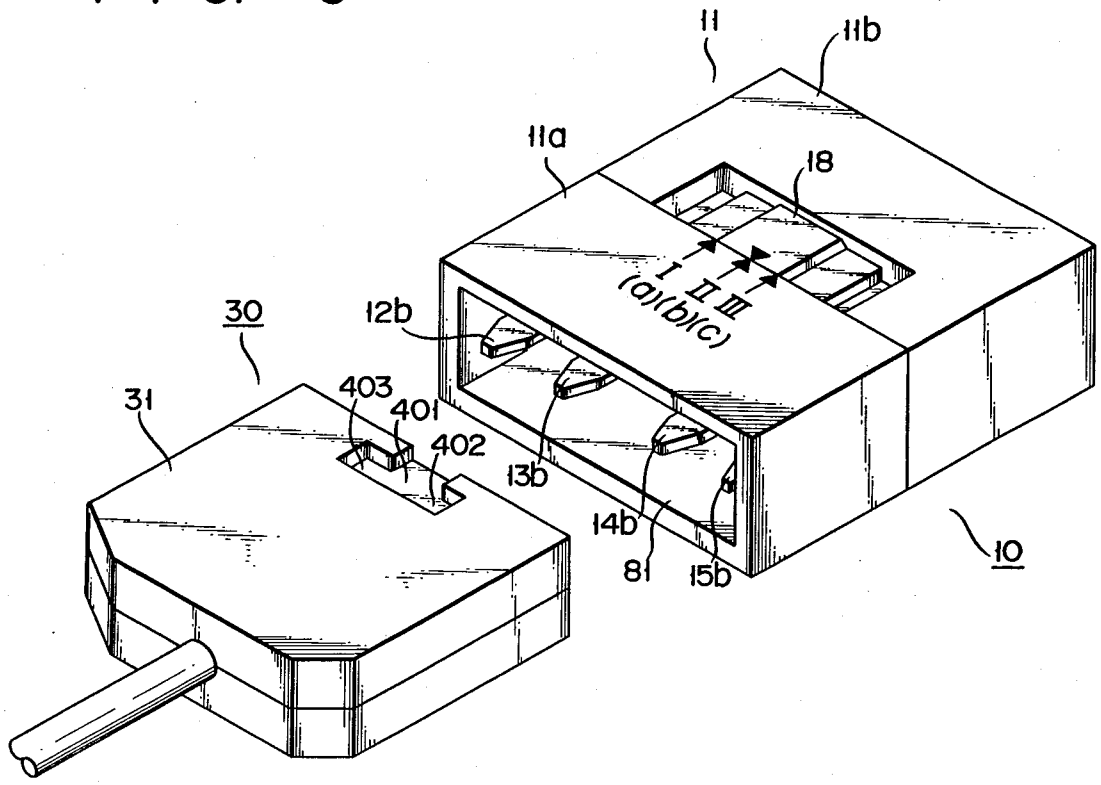
FIG. 6 is a perspective view showing the branch connector of FIG. 5.
Figure 7:
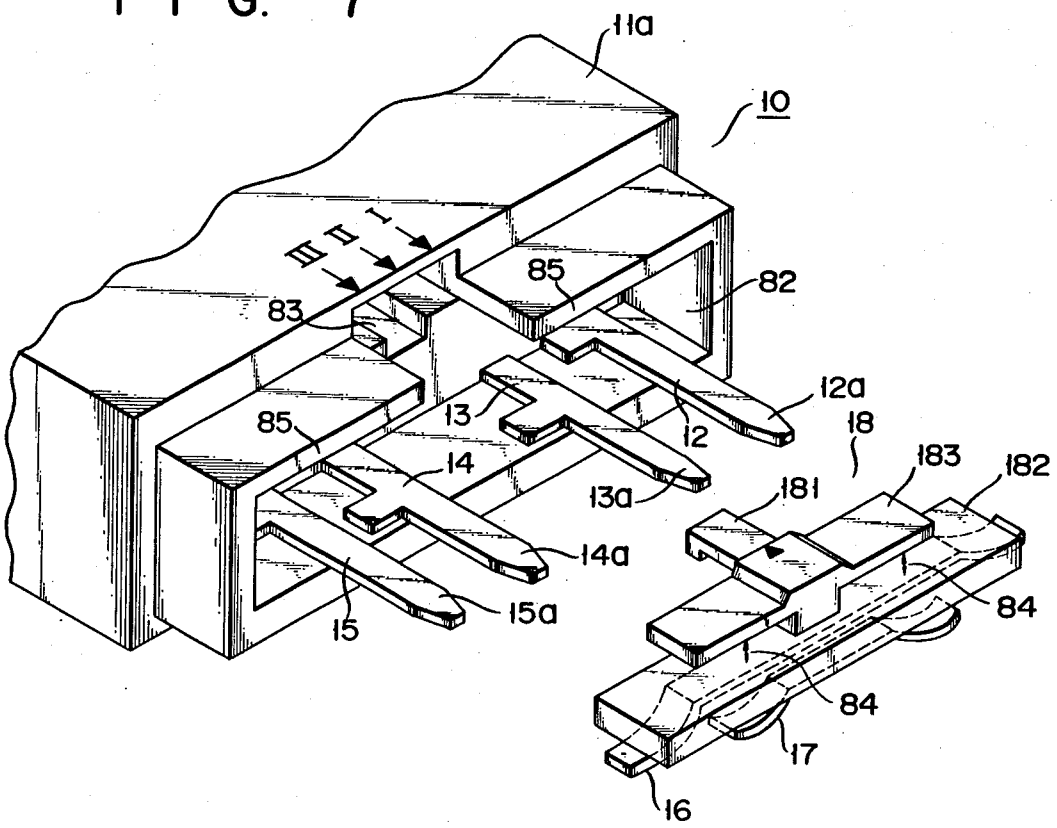
FIG. 7 is a view showing a manner in which the branch connector of FIG. 5 is assembled.

The branch connector equipped with switches can be so configured as shown, for example, in FIGS. 5 to 7 in which identical reference numerals are employed to designate parts or units corresponding to those shown in FIG. 4.

In FIG. 5 branch connector 10 has case 11 comprised of a connector body in which four contact pins 12, 13, 14 and 15 are arranged in a parallel array. The ends of respective contact pins 12 to 15 constitute signal line connection terminals 12*a* to 15*a* to which are connected signal lines 23 and 24 of connector elements 20 for signal line connection, while, on the other hand, the opposite ends of contact pins 12 to 15 constitute external circuit connection terminals 12*b* to 15*b* adapted to be connected to signal lines 23 and 24 through connection terminals 32, 33, 34 and 35 in connector element 30.

Projections 121, 131, 141 and 151 extend at right angles to the axis of the respective contact pins such that they are located partway of their lengths. Conductor slide pieces 16 and 17 are provided, as switches, so that pins 12 and 15 may be conductively connected through slide piece 16 at their base point (b) and that pins 13 and 14 may be conductively connected through slide piece 17 at their base points (b). Slide pieces 16 and 17 and thus their contact areas 161 and 171 are adapted to be moved in a direction orthogonal to the length of the pins and in a range between points (a), located away from the contact pins, and (c) on the projections with the base points (b) as a reference.

As evident from FIG. 5, when contact areas 161 and 171 of the slide pieces positioned at the points (b) and (c), contact pins 12 and 15, as well as contact pins 13 and 14, are short-circuited and, when contacts 161 and 171 are positioned at the point (a), contact pins 12 and 15, as well as contact pins 13 and 14, are open-circuited. In order for slide pieces 16 and 17 to be moved simultaneously across the pins, they are coupled to common insulating slide plate 18. Slide plate 18 is attached to body case 11 such that, as shown in FIG. 6, it is moved within a range between points I and III with point II as a reference in a manner corresponding to three points (a), (b) and (c).

Hook 181 is formed midway of slide plate 18 such that it extends toward connector element 30 for external circuit connection, i.e., in the same direction as that in which contact pins extend. The forward end of hook 181 is bent down perpendicularly and serves to prevent connector element 30 from being disengaged from body case 11.

That is, guide groove 401 is formed at case 31 of connector element 30 for external circuit connection such that it is centrally located opposite to body case 11. Locking grooves 402 and 403 are formed at both the sides of guide groove 401 in a manner communicating with guide or insertion groove 401. When case 31 of connector element 30 is inserted into opening 81 of case 11 with slide plate 18 set at the position II, hook 181 is guided into guide groove 401. The position and size of guide groove 401 are so set that case 31 of connector element 30 can be inserted into case 11 only when slide plate 18 is set at the position II. When slide plate 18 is slidably moved to the position I or III after case 31 of connector element 30 has been inserted into case 11 through guide 401, hook 181 is engaged in locking groove 403 or 402 whereby connector element 30 is locked to connector body 11.

As set forth above, the sliding movement of slide plate 18 are effected in association with the short- and open-circuiting of pins 12 to 15. During the insertion and withdrawing of connector element 30 slide plate 18 is placed in the position II at which time contact pins 12 and 15, as well as contact pins 13 and 14, are short-circuited with signal lines directly connected, or strapped, thereto. With connector element 30 locked to connector case 11, the contact pins are short- or open-circuited through the selection of the slide plate position III or I, respectively. With the slide plate located in the position I, signal lines are branched to an associated device, not shown, through connection lines 23 and 24 in the connector element 30 for external circuit connection. When, on the other hand, the locked connector element 30 is to be detached from body case 11, slide plate 18 is brought back to the unlocked position II and, in this way, the contact pin is short-circuited and connector element 30 is withdrawn.

Since connector element 30 can be detached with slide plate 18 placed only in the position II, i.e., the signal lines strapped as set out above, the signal lines are not cut off even after the withdrawal of connector element 30.

FIG. 7 shows the way the slide plate is attached to body case. As shown in FIG. 6, body case is comprised of two sub-cases 11*a* and 11*b*. Contact pins 12 to 15 are provided in one sub-case 11*a*. Groove 83 on the signal line side of opening 82 communicates with opening 81 (See FIG. 6) on the external circuit side. With hook 181 directed to groove 83, slide plate 18 is inserted into sub-case 11*a* so that a portion 85 of the frame surrounding opening 82 is fitted into clearance 84 between lower piece 182 and upper piece 183 of slide plate 18. Thereafter, another sub-case 11*b* (See FIG. 6) is fitted over the frame surrounding of case 11*a* to provide case 11 as shown in FIG. 6.

As shown in the signal line circuit of FIG. 4, slide pieces 16 and 17 of FIGS. 5 and 6 can be shown as switches. Positions I, II and III of slide plates as shown in FIG. 6 correspond to (I), (II) and (III) in FIG. 4.

In the information processing system shown in FIG. 4, connector 40 (shown in FIGS. 8 to 10) can be used which, in order to obtain terminating signal lines 23 and 24, possesses a terminating resistor-equipped circuit 70. Furthermore, connector 40′ can be employed in place of connector 10 mentioned above so that signal lines 23 and 24 as shown in FIG. 4 are branched to the respective unit. Needless to say, connectors 10 shown in FIG. 4, together with connectors 40 and 40′, may be employed for a common signal line circuit.

Figure 9:
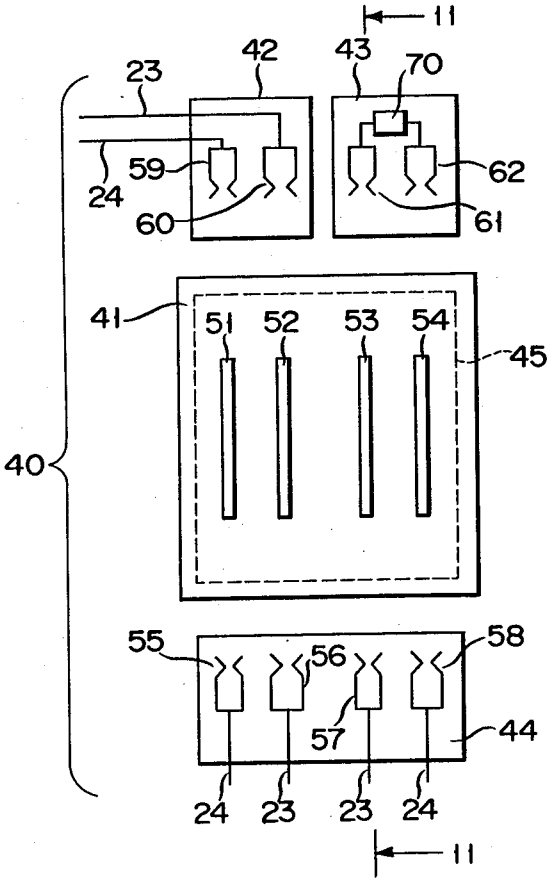
FIG. 9 is an expanded view showing the connector device shown in FIG. 8.
Figure 11:
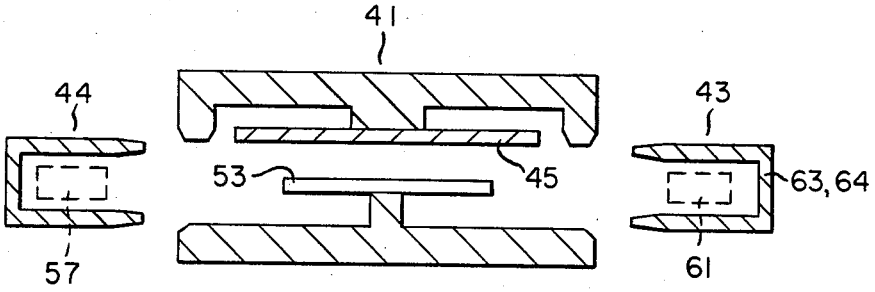
FIG. 11 is a schematical cross-sectional view of the connector device shown in FIG. 9 taken along line 11—11.

As shown in FIG. 9, connector 40 is comprised of connector body 41, first connector element 42 for signal line connection, second connector element 43 for signal line termination and connector element 44 for connection to the unit. Connector body 41 includes a first pair of pin terminals 51, 52 and second pair of pin terminals 53 and 54. Four pin terminals 51, 52 and 53, 54 are of a mutually independent type and of the same configuration type. The one ends of these respective pin terminals are matingly connected to female terminals 55, 56, 57 and 58 in connector element 44 for connection to the unit, whereas the other ends of pin terminals 51 and 52 of connector body 41 are matingly connected to female terminals 59 and 60 in connector element 42.

The other ends of pin terminals 53 and 54 in connector body 41 is matingly connected to female terminals 61 and 62 in second connector element 43. Predetermined circuit 70 including a terminating resistor is connected between female terminals 61 and 62. Connector 40 with three connector elements 42 to 44 connected to connector body 41 functions as a terminating branch connector as shown in FIG. 8.

Figure 8:
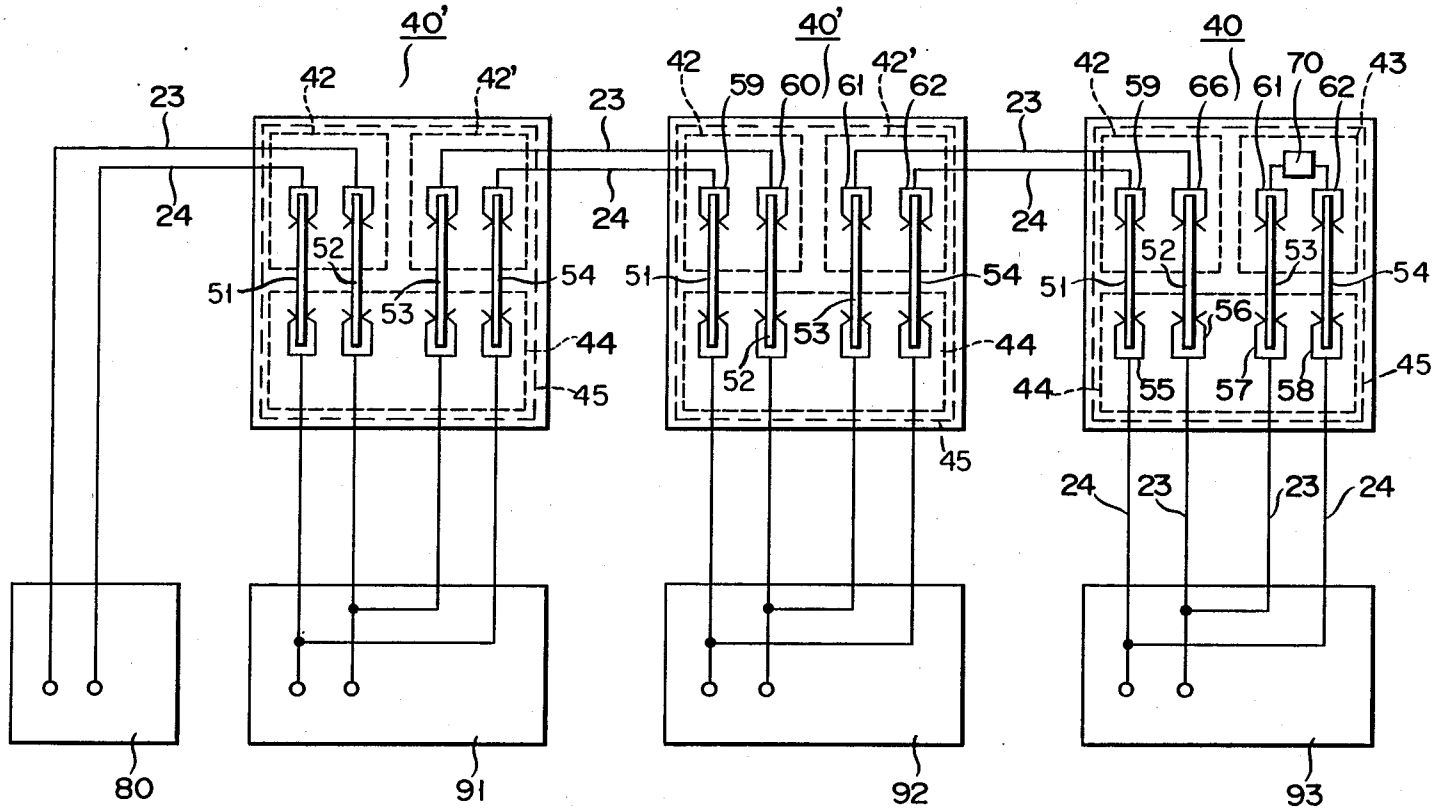
FIG. 8 is a signal line circuit diagram for an information processing unit for use in an electric connector unit according to another embodiment of this invention.

As indicated by connector 40′ in FIG. 8, connector element 42′ is connected to pin terminals 53 and 54 in connector body 41 and is of the same type as first connector element 42 for signals line connection. Respective connector 40′ branches the signal lines to the respective terminal unit and functions as a branch connector.

The use of connectors 40 and 40' can assures a ready installation of the branch connector in increasing and decreasing the information processing terminal units. As shown in FIG. 8, for example, if an additional terminal unit is to be provided, the extensions of signal lines 23 and 24 must be made. In this case it is only necessary to use connector element 42' in place of connector element 43 of connector 40. This eliminates the need of separating connector 40 from terminal unit 93 as in the prior art. Where, for example, terminal unit 93 as well as connector 40 are to be detached from the system, connector element 43 for signal line termination may be used in place of connector element 42' of connector 40' connected to unit 92.

Figure 10:
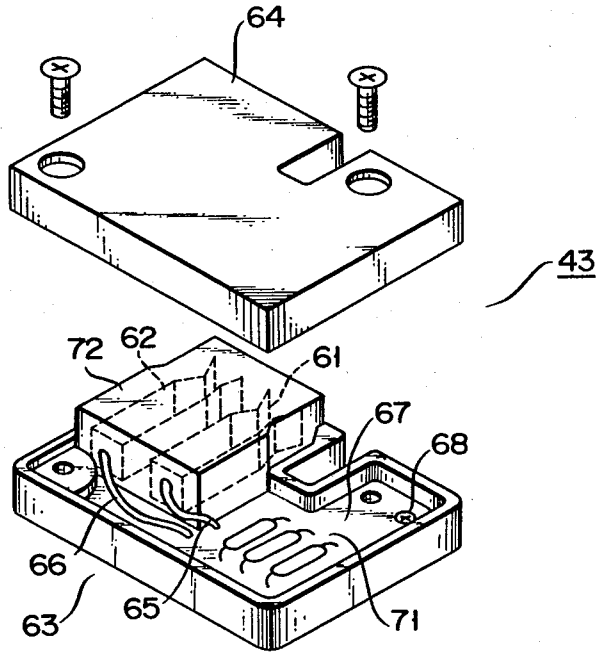
FIG. 10 shows one form of the connector of FIG. 9.

FIG. 10 shows one form of connector element 43 for signal line termination. Connector element 43 is comprised of first and second case halves 63 and 64 made of a metal. Insulating housing 72 with female terminals 61 and 62 incorporated therein is attached to first case half 63 such that wires 65 and 66 extend from female terminals 61 and 62 and are connected to printed circuit board 67 on which terminating resistors 71 are mounted. Printed circuit board 67 is secured by screws 68 to the first case half. The second case half is coupled to the first case half, thus providing second connector element 43.

Connector element 42 for signal line connection can be formed, with the use of the same parts as those of the connector element 43 of FIG. 10, in which case wires 65 and 66 extend from holes (no shown) at the bottom of first case half 63 to the outside of first case half 63 without using any terminating resistors.

It is preferable that connector element 44 be formed of a metal case as in the case of connector elements 42 and 43. Preferably, a metal plate 45 is attached to connector body 41 so that the cases of three connector elements 42, 43 and 44 are placed in common contact with the metal plate. Furthermore, the shields of signal lines 23 and 24 are placed in contact, the respective case of connector elements 42 and 43. By so doing, connector 40 is completely shielded.

What is claimed is:

1. A branch connector apparatus, comprising:

a connector body inserted at an intermediate point of at least one signal line, in series with the signal line, the connector body including:

(a) at least one pair of first terminals connected to the signal line, (b) at least one switching piece to be selectively connected to the first terminals, and (c) switch-driving member integral with the switching piece, the switch-driving member being movable between a first position, where the switching piece is separated from the first terminals, and a second position, where the switching piece is in contact with the first terminals; and a connector element attachable to and detachable from the connector body, the connector element including:

(a) at least one pair of second terminals which are connected to the first terminals when the connector element is attached to the connector body, and which are separated from the first terminals when the connector element is detached from the connector body, and (b) guide means for guiding the switch-driving member when the switch-driving member is at the second position, thereby enabling the connector element to be attached or detached from the connector body.

2. An apparatus according to claim 1, wherein the connector body includes a connector body case which contains at least one pair of the first terminals and to which the switch-driving member is movably attached, and the connector element incldues a connector element case which contains at least one pair of the second terminals and for which the guide means is provided.

3. An apparatus according to claim 2, wherein the guide means includes a guide groove formed on the connector element case, and the switch-driving member includes a projection to be guided along the guide groove.

4. An apparatus according to claim 2, wherein the connector element case is provided with lock means which engages with the switch-driving member when the switch-driving member is at the first position, the connector element case being prevented from coming off from the connector body case by engagement of the lock means with the switch-driving member.

5. An apparatus according to claim 4, wherein the guide means includes a guide groove formed on the connector element case, the switch-driving member includes a projection to be guided along the guide groove, and the lock means includes at least one locking groove which communicates with the guide groove and with which the projection of the switch-driving member engages.

6. An apparatus according to claim 2, wherein the switch-driving member is movable also to a third position which is different from the second position and where the switching piece is in contact with the first terminals; and the connector element case is provided with lock means which engages the switch-driving member when the switch-driving member is at the first position and the third position, the connector element case being prevented from coming off from the connector body case by engagement of the lock means with the switch-driving member.

7. An apparatus according to claim 6, wherein the guide means includes a guide groove formed on the connector element case, the switch-driving member includes a projection to be guided along the guide groove, and the lock means includes at least one locking groove which communicates with the guide groove and with which the projection of the switch-driving member engages.

8. An apparatus according to claim 2, wherein the connector body case contains one pair of the first terminals and the connector element case contains one pair of the second terminals.

9. An apparatus according to claim 7, wherein the connector body case contains one pair of the first terminals and the connector element case contains one pair of the second terminals.

10. An apparatus according to claim 9, wherein the pair of first terminals include:

(a) a first contact pin having a first signal line connection terminal to be connected to the signal line and a first external circuit connection terminal to be connected to the second terminal, and (b) a second contact pin arranged parallel to the first contact pin and having a second signal line connection terminal to be connected to the signal line and a second external circuit connection terminal to be connected to the second terminal, the switching piece includes a slide piece formed of an electrically conductive material, and the switch-driving member includes an electrically insulative slide plate which is slidable perpendicular to the first and second contact pins and a hook extending perpendicular to a direction in which the switch-driving member slides.

11. An apparatus according to claim 10, wherein each of said first and second contact pins includes a body portion extending along an axis of the contact pin, and a projection extending at right angles to an axis of the body portion such that the projection is located partway of each contact pin length, said slide piece has contact areas at each end portion of the slide piece, and said contact areas are movable in a direction orthogonal to the lengthwise direction of said contact pins and in a range between points, located away from the contact pins, and points on the projections, with points on the body portion as a reference.

12. An apparatus according to claim 10, wherein said hook has an end bent perpendicularly.

13. An apparatus according to claim 11, wherein said guide groove on said connector element case is centrally located opposite to said body case, said locking groove is formed at both sides of said guide groove in a manner communicating with said guide groove, and said guide groove and locking grooves are formed such that, where said hook of said slide plate engages one of said locking grooves, said contact areas are in contact with the points on said projections; where said hook of said slide plate engages another of said locking grooves, said contact areas are positioned at the points away from said contact pins; and where side hook of said slide plate is on said guide groove, said contact areas are positioned at the points on the body portion.

14. An apparatus according to claim 2, wherein the connector body includes two pairs of the first terminals, and two switching pieces, and the connector element includes a connector element case containing two pairs of the second terminals.

15. An apparatus according to claim 7, wherein the connector body includes two pairs of the first terminals, and two switching pieces, and the connector element includes a connector element case containing two pairs of the second terminals.

16. An apparatus according to claim 15, wherein the first terminals of each pair include (a) a first contact pin having a first signal line connection terminal to be connected to the signal line and a first external circuit connection terminal to be connected to the second terminal, and (b) a second contact pin arranged parallel to the first contact pin and having a second signal line connection terminal to be connected to the signal line and a second external circuit connection terminal to be connected to the second terminal, each of the two switching pieces includes a slide piece formed of an electrically conductive material, and the switch-driving member includes an electrically insulative slide plate which is slidable perpendicular to the first and second contact pins and a hook extending perpendicular to a direction in which the switch-driving member slides.

17. An apparatus according to claim 16, wherein each of said first and second contact pins includes a body portion extending along an axis of the contact pin, and a projection extending at right angles to an axis of the body portion such that the projection is located partway of each contact pin length, each of said slide pieces has contact areas at each end portion of the slide piece, and said contact areas are movable in a direction orthogonal to the lengthwise direction of said contact pins and in a range between points, located away from the contact pins, and points on the projections, with points on the body portion as a reference.

18. An apparatus according to claim 16, wherein said hook has an end bent perpendicularly.

19. An apparatus according to claim 18, wherein said guide groove on said connector element case is centrally located opposite to said body case, said locking groove is formed at both sides of said guide grooves in a manner communicating with said guide groove, and said guide groove and locking grooves are formed such that, where said hook of said slide plate engages one of said locking grooves, said contact areas are in contact with the points on said projections; where said hook of said slide plate engages another of said locking grooves, said contact areas are positioned at the points away from said contact pins; and where said hook of said slide plate is on said guide groove, said contact areas are positioned at the points on the body portion.

* * * * *